US008500138B2

(12) United States Patent
Visinski et al.

(10) Patent No.: US 8,500,138 B2
(45) Date of Patent: Aug. 6, 2013

(54) SKATEBOARD TRUCK WITH REPLACEABLE HANGER AND HANGER FOR SKATEBOARD TRUCK

(75) Inventors: Andrew M. Visinski, Shelton, CT (US); Josef F. Visinski, Shelton, CT (US); Wayne A. Gallipoli, West Haven, CT (US); Jean Louis Picouet, Waukesha, WI (US)

(73) Assignee: Surf-Rodz LLC, Seymour, CT (US)

( * ) Notice: Subject to any disclaimer, the term of this patent is extended or adjusted under 35 U.S.C. 154(b) by 0 days.

(21) Appl. No.: 13/200,063

(22) Filed: Sep. 16, 2011

(65) Prior Publication Data

US 2012/0068428 A1 Mar. 22, 2012

Related U.S. Application Data

(60) Provisional application No. 61/403,607, filed on Sep. 17, 2010.

(51) Int. Cl.
*A63C 17/01* (2006.01)

(52) U.S. Cl.
USPC ..... 280/11.27; 280/87.042; 280/11.28

(58) Field of Classification Search
USPC ..... 280/11.27, 11.28, 87.042
See application file for complete search history.

(56) References Cited

U.S. PATENT DOCUMENTS 4,159,830 A * 7/1979 Solimine ..... 280/11.28
4,184,693 A * 1/1980 Whitmarsh ..... 280/11.28
4,776,604 A * 10/1988 Valdez et al. ..... 280/87.041
5,068,956 A * 12/1991 Malewicz ..... 29/437
5,263,725 A * 11/1993 Gesmer et al. ..... 280/11.28
5,794,955 A * 8/1998 Flynn ..... 280/87.042
5,810,369 A * 9/1998 Wilder et al. ..... 280/11.231
5,879,013 A * 3/1999 Shih ..... 280/11.28
6,123,348 A * 9/2000 Miller ..... 280/87.042
6,131,921 A * 10/2000 Ellis et al. ..... 280/11.211
6,182,987 B1 * 2/2001 Bryant ..... 280/87.042
6,224,076 B1 * 5/2001 Kent ..... 280/87.042
6,299,186 B1 * 10/2001 Kao et al. ..... 280/87.041
6,382,646 B1 * 5/2002 Shaw ..... 280/87.041
6,428,023 B2 * 8/2002 Reyes et al. ..... 280/87.042
6,616,155 B2 * 9/2003 Tuan ..... 280/87.041
6,648,372 B2 * 11/2003 Ojeda, III ..... 280/809
6,659,480 B1 * 12/2003 Newman ..... 280/87.042
6,761,369 B1 * 7/2004 Anderson ..... 280/87.042
6,793,224 B2 * 9/2004 Stratton ..... 280/87.042
6,913,272 B2 * 7/2005 Chang ..... 280/87.042
6,932,362 B1 * 8/2005 Barrett ..... 280/11.27
6,945,542 B2 * 9/2005 Stewart ..... 280/11.27
7,044,485 B2 * 5/2006 Kent et al. ..... 280/87.042
7,093,842 B2 * 8/2006 Chmelar ..... 280/87.042
7,104,558 B1 * 9/2006 Saldana ..... 280/87.042
7,140,621 B2 * 11/2006 Cheng ..... 280/11.27
7,150,460 B2 * 12/2006 Williams ..... 280/87.042
7,243,925 B2 * 7/2007 Lukoszek ..... 280/11.28
7,255,356 B2 * 8/2007 Lin ..... 280/87.041

(Continued)

*Primary Examiner* — J. Allen Shriver, II
*Assistant Examiner* — Travis Coolman
(74) *Attorney, Agent, or Firm* — Ware, Fressola, Maguire & Barber LLP

(57) ABSTRACT

A skateboard truck and hanger therefor, the skateboard truck including a base plate, a bushing support, and a hanger which is dimensioned for removable securement to the bushing support. The hanger is preferably removably secured to the bushing support by means of machine screws passing through openings in the bushing support for threaded engagement in threaded openings within the hanger.

8 Claims, 10 Drawing Sheets

U.S. PATENT DOCUMENTS

| | | | | |
|---|---|---|---|---|
| 7,316,408 | B2 * | 1/2008 | McClain | 280/87.042 |
| 7,364,174 | B2 * | 4/2008 | Morris | 280/87.042 |
| 7,984,917 | B2 * | 7/2011 | Lake et al. | 280/87.042 |
| 2002/0084602 | A1 * | 7/2002 | Feng | 280/11.223 |
| 2004/0140633 | A1 * | 7/2004 | Beedle et al. | 280/11.27 |
| 2005/0051983 | A1 * | 3/2005 | Williams | 280/87.042 |
| 2006/0006622 | A1 * | 1/2006 | Gesmer et al. | 280/87.042 |
| 2008/0179844 | A1 * | 7/2008 | DiDomizio | 280/11.27 |
| 2010/0314851 | A1 * | 12/2010 | Palmer et al. | 280/87.042 |
| 2011/0057400 | A1 * | 3/2011 | Wills | 280/11.203 |
| 2011/0210526 | A1 * | 9/2011 | Williams, Jr. | 280/11.28 |
| 2012/0146303 | A1 * | 6/2012 | Wilson | 280/87.042 |
| 2012/0223492 | A1 * | 9/2012 | Ackerman | 280/11.27 |

* cited by examiner

A
32
Skate Board Deck
50
12
100
20
34
26
36
10
25
27
32

SKATEBOARD TRUCK WITH REPLACEABLE HANGER AND HANGER FOR SKATEBOARD TRUCK

CROSS REFERENCE TO RELATED APPLICATION

This application claims priority under 35 USC §119 to U.S. provisional patent application No. 61/403,607 filed on Sep. 17, 2010. U.S. provisional application 61/403,607 filed on Sep. 17, 2010 is also hereby incorporated by reference.

TECHNICAL FIELD

This invention relates to a skateboard truck used on skateboards and the like, as well as a hanger for a skateboard truck.

BACKGROUND OF THE INVENTION

Skateboards include a steering mechanism known as trucks. Trucks are mounted on the underside of a skateboard deck, one in the front and one in the rear. Each truck has a pair of wheels attached thereto at respective ends of an axle of the truck. The truck provides support of the wheels, as well as the steering mechanism for the wheels depending upon the pressure exerted to the top of the skateboard deck. There is a need to be able to replace hangers used on skateboard trucks when such hangers become worn or if the user desires to change the characteristics of the skateboard by changing the length of the hangers.

SUMMARY OF THE INVENTION

A skateboard truck according to an embodiment of the present invention includes a replaceable hanger dimensioned for insertion of axles upon which wheels are attached. The replaceable hanger includes a pair of threaded apertures dimensioned for receipt of machine screws. The machine screws with associated lock washers pass through a bushing support and thereby secure the hanger to the bushing support.

The hanger further includes a pair of cylindrical openings, each for receipt of an axle. A grub screw is dimensioned for threaded engagement with each axle. The hanger includes radially extending openings for passage of the grub screws so as to secure the axle in the cylindrical opening. Each axle is dimensioned for receipt of a wheel.

A skateboard truck according to an embodiment of the present invention is thereby able to easily allow replacement of a hanger if the hanger becomes worn through, for example, acrobatic skateboard activities, and also allows the hanger to be changed so that the overall skateboard can be used for different applications, such as shorter hangers for acrobatic use and longer hangers for non-acrobatic use.

An embodiment of the present invention is a skateboard truck comprising a base plate; a bushing support having passthrough openings formed therein; a fastener assembly configured to secure the bushing support to the base plate; fasteners configured to pass through the passthrough openings, a hanger having receiving areas configured to receive the fasteners passing through the passthrough openings of the bushing support so as to removably secure the hanger to the bushing support, and axles configured to engage openings at first and second ends of the hanger.

Another embodiment of the present invention is a skateboard truck as described wherein the fastener assembly comprises a kingpin extending from the baseplate and through an opening in the bushing support, as well as bushings positioned around the kingpin and on either side of the opening in the bushing support.

Another embodiment of the present invention is a skateboard truck as described, wherein the bushings are fabricated from an elastically resilient material.

Another embodiment of the present invention is a skateboard truck as described wherein each axle is secured to the hanger by a grub screw.

Another embodiment of the present invention is a skateboard truck as described, wherein the hanger is fabricated from billet aluminum.

Another embodiment of the present invention is a skateboard truck as described, wherein the bushing support further includes a protrusion dimensioned for receipt within an aperture formed within the baseplate.

Another embodiment of the present invention is a skateboard truck as described, wherein the protrusion terminates with a hemispherically shaped end.

Another embodiment of the present invention is a skateboard truck as described, wherein the receiving areas of the hanger are threaded openings formed in the hanger.

Another embodiment of the present invention is a skateboard truck as described, further comprising a locknut positioned around each machine screw and between an end of each machine screw and said hanger.

A still further embodiment of the present invention is a hanger for removable securement with a bushing support of a skateboard truck, the hanger comprising openings at first and second ends for receipt of axles and means for removably securing the hanger to the bushing support.

Another embodiment of the present invention is a hanger as described, wherein the means for securing the hanger to the bushing support comprises threaded openings in an underside wall of the hanger configured to matingly engage with machine screws dimensioned for passing through openings in the bushing support.

Another embodiment of the present invention is a hanger as described, further comprising a locknut positioned around each machine screw and between an end of each machine screw and said hanger.

Another embodiment of the present invention is a hanger as described, wherein the hanger is fabricated from billet aluminum.

Another embodiment of the present invention is a hanger as described, further comprising a grub screw configured to secure each axle in an opening of the hanger.

DETAILED DESCRIPTION

Figure 1:
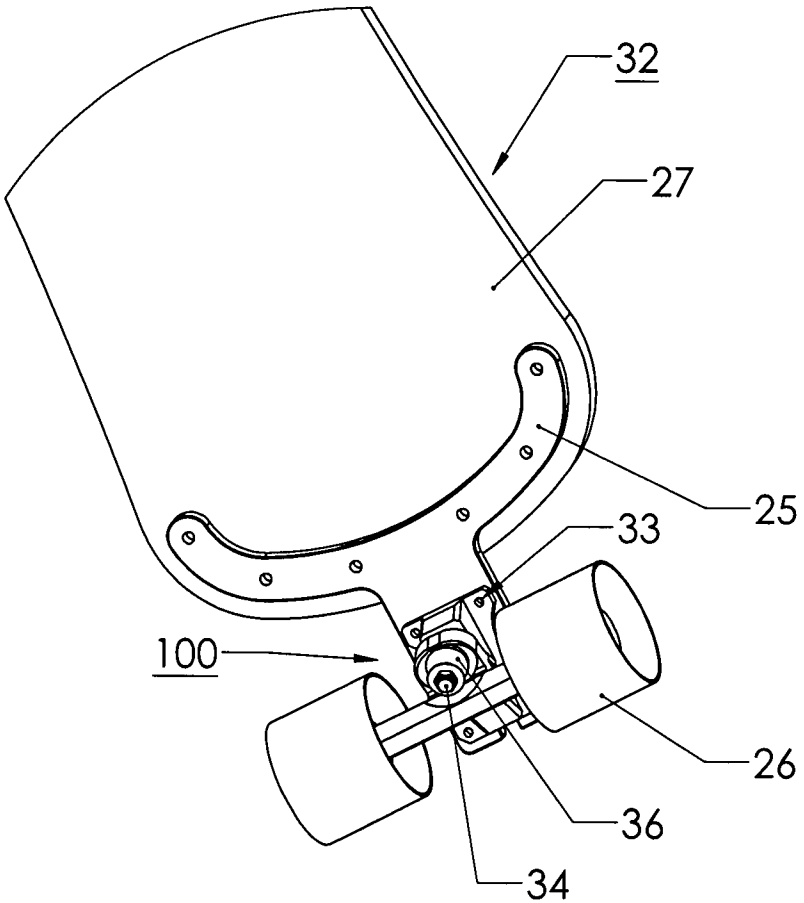
FIG. 1 is a perspective of the of the skateboard truck showing its attachment to a support member in turn fastened to the bottom of the deck forming an overall skateboard.
Figures 1A, 1B:
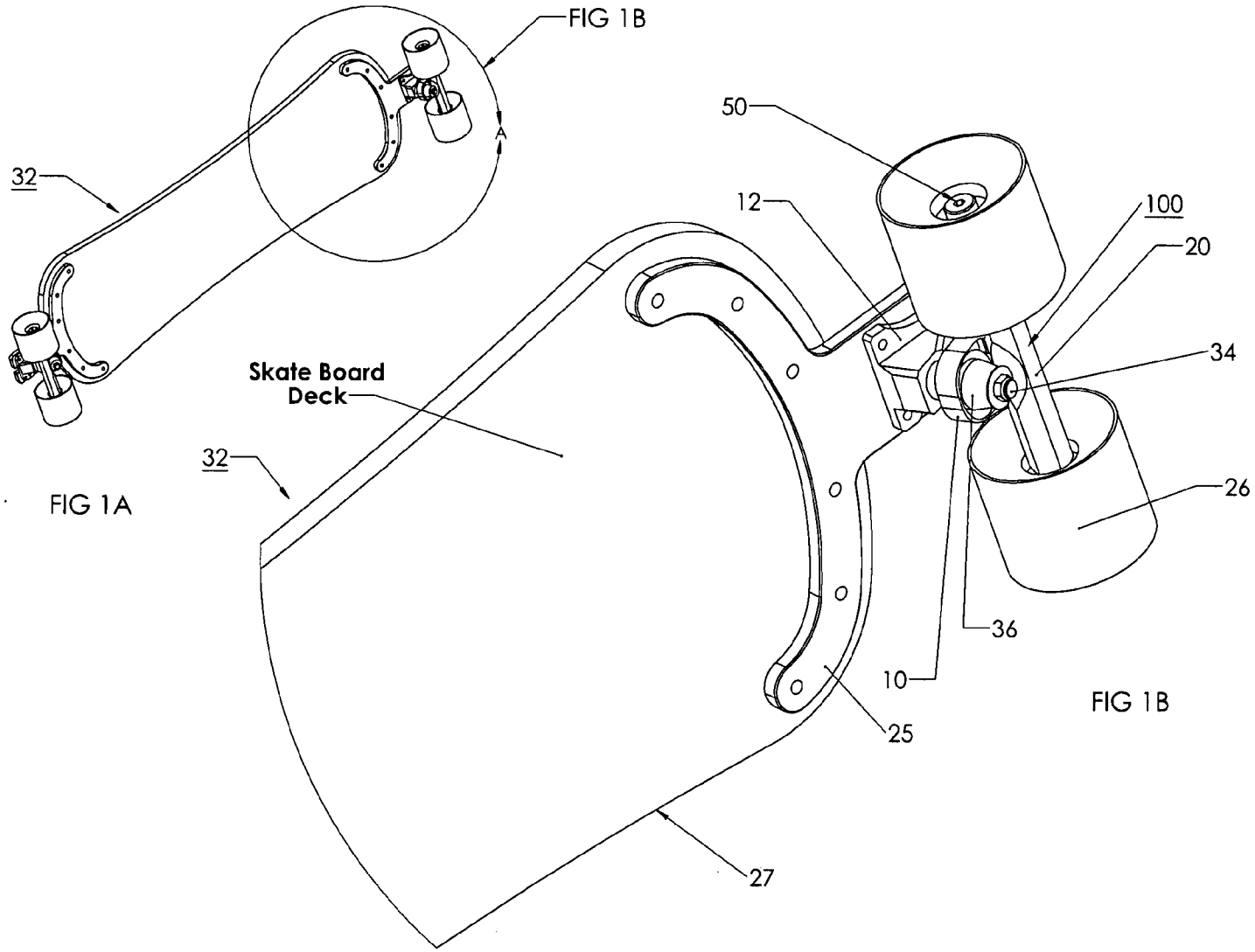
FIGS. 1A-1D are perspective views of a skateboard according to the present invention.
Figure 1D:
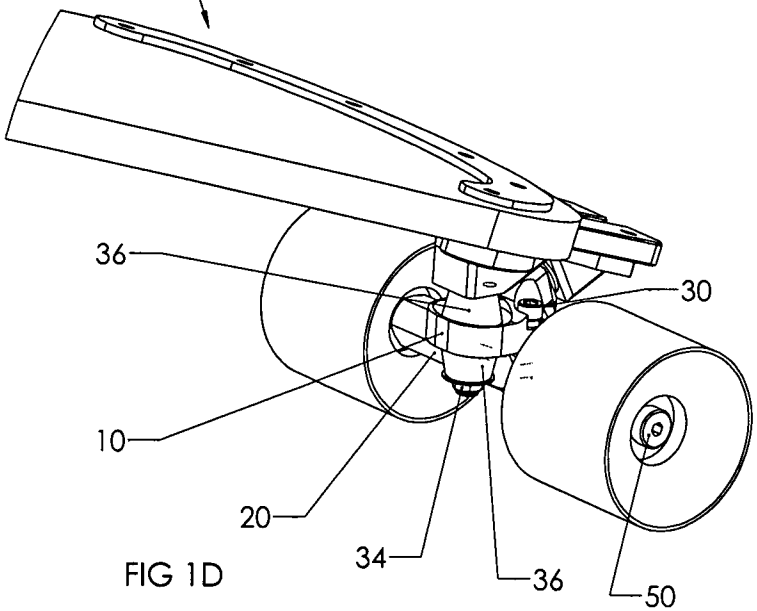
Figure 1C:
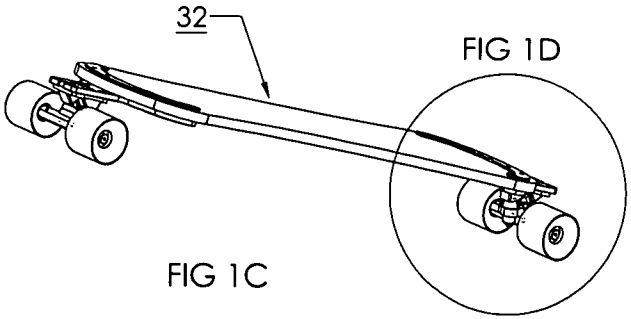
Figure 2:
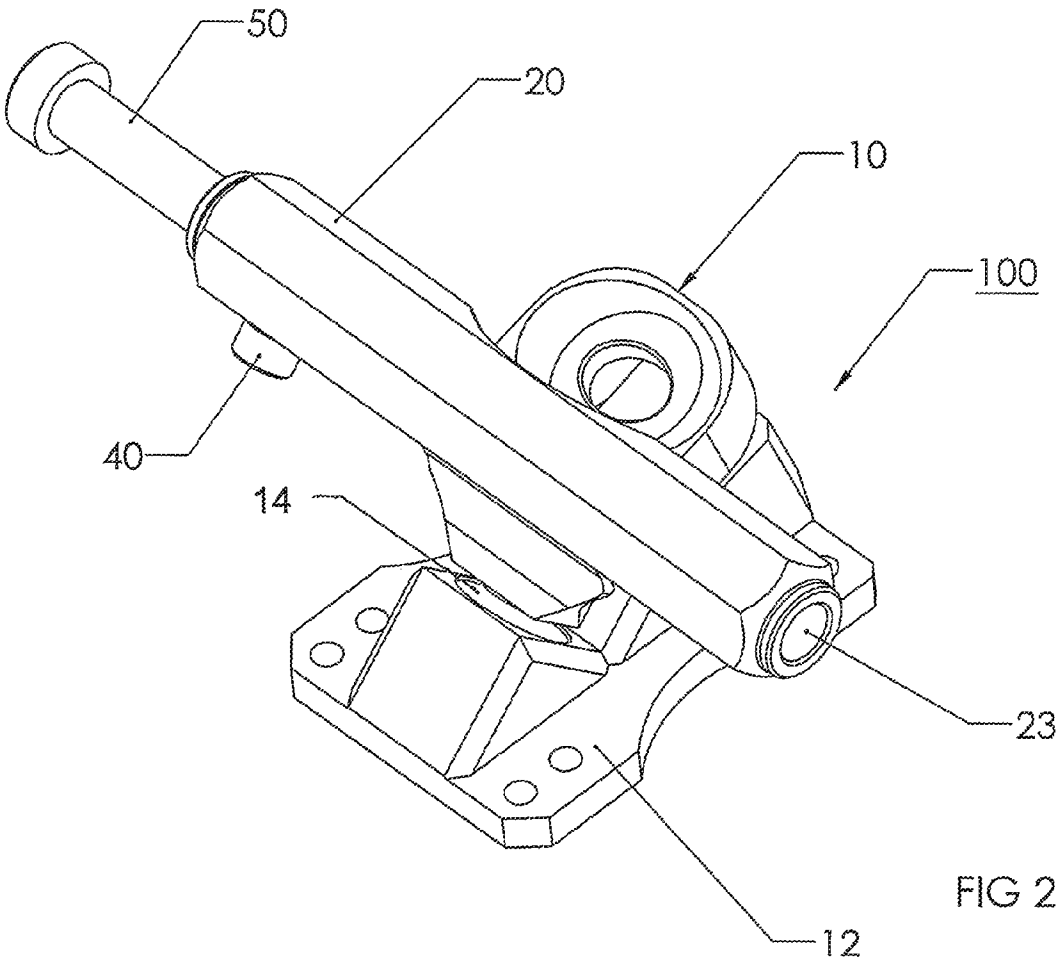
FIG. 2 is an exploded perspective view of the skateboard truck, including the hanger according to the present invention.
Figure 3:
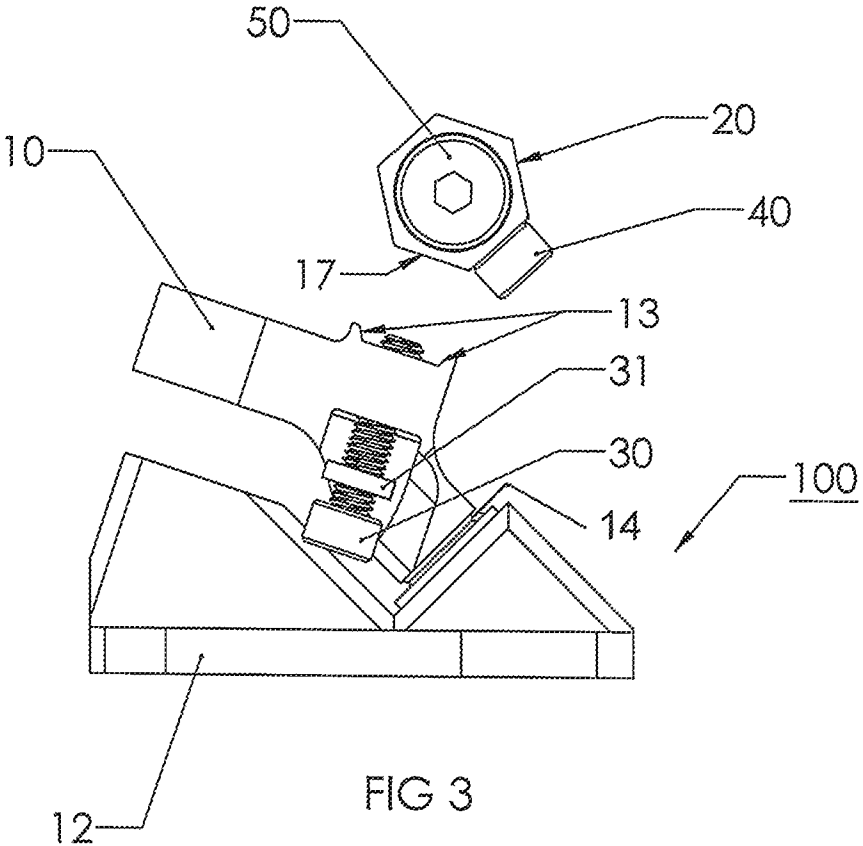
FIG. 3 is an exploded perspective view of the skateboard truck according to the present invention taken from the left-hand side relative to the skateboard truck shown in FIG. 1.

As best seen in FIGS. 1, 1A-1D, 2, and 3, a skateboard truck 100 according to the present invention is attached to a support member 25 which in turn is attached to the underside of a deck 27 of an overall skateboard 32. The skateboard truck includes a base plate 12, a bushing support 10, a hanger 20, axles 50, grub screws 40 for securing the axles to the hanger, and machine screws 30 and locknuts 31 for securing the hanger to the bushing support. The overall skateboard truck 100 is secured to the support member 25 by means of fasteners 33 (such as machine screws) as best seen in FIGS. 1 and 1A-1D. The skateboard truck includes a fastener assembly, such as a kingpin 34 and bushings 36 with the kingpin passing through bushing support 10 into threaded engagement with base plate 12. The bushings may be fabricated from a resilient material, such as urethane. The bushing support also includes a protrusion 44 having a hemispherically shaped end 46 that is dimensioned to interfit within an aperture 14 of the baseplate. FIG. 3 shows protrusion 44 seated within aperture 14 of baseplate 12. FIGS. 1 and 1A-1D show bushing support 10 secured to baseplate 12.

Figure 6:
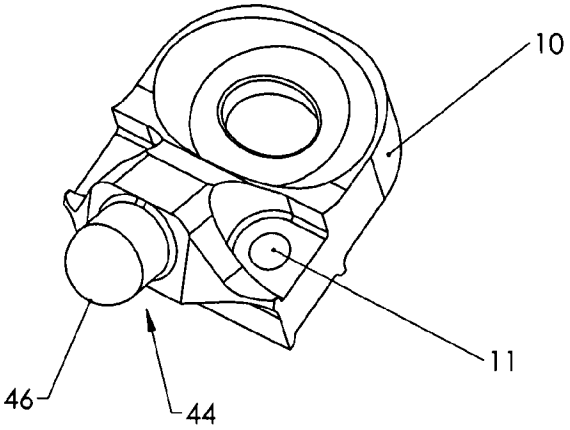
FIG. 6 is another perspective view of the bushing support from a side opposite of that shown in FIG. 5.
Figure 5:
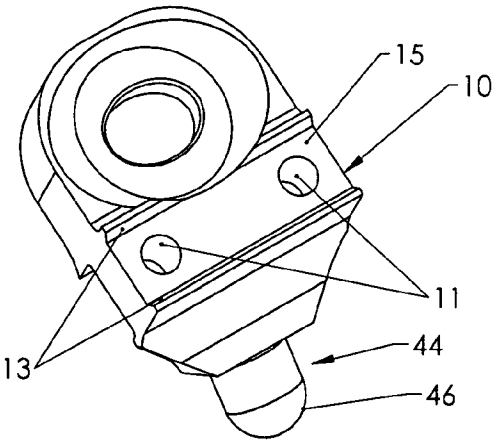
FIG. 5 is a perspective view of the bushing support from a direction substantially corresponding to that shown in FIG. 1.
Figure 7:
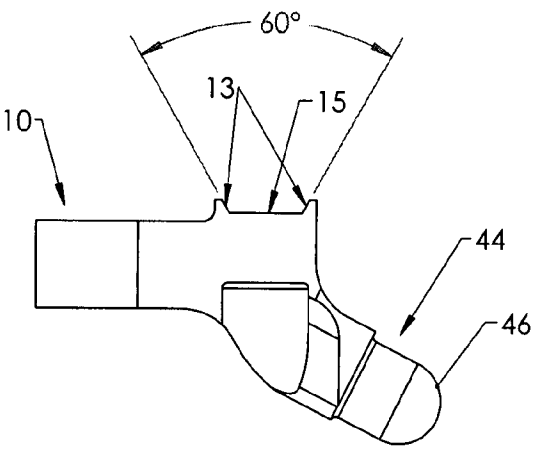
FIG. 7 is a side elevational view of the bushing support.

FIGS. 5, 6, and 7 show the bushing support 10 and associated passthrough holes 11 for passing the machine screws 30 therethrough. Also shown are ridges 13 and flat surface 15 that securely position a face 17 of hanger 20 thereto as best seen in FIG. 3.

Figure 4:
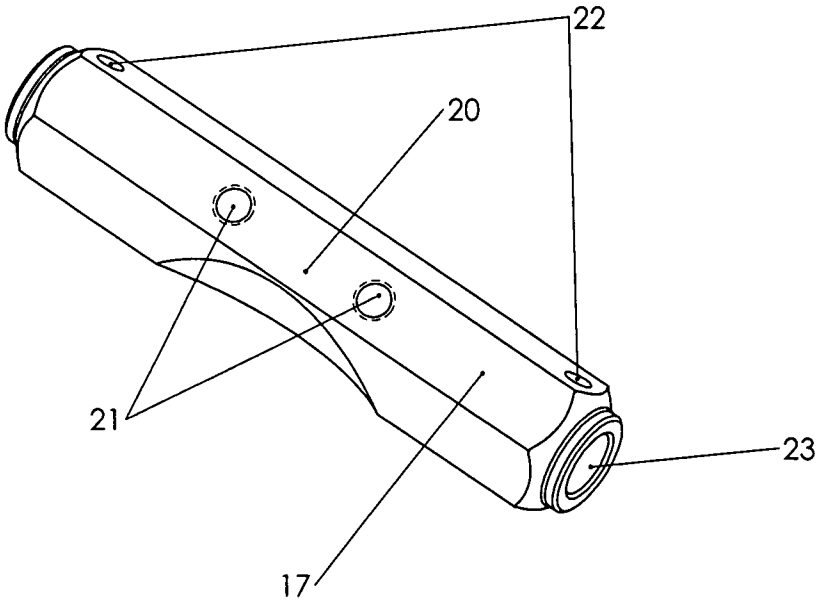
FIG. 4 is a perspective view of the hanger according to the present invention.

As best seen in FIGS. 2, 3, and 4, the hanger is secured to bushing support 10 by machine screws (fasteners) 30 passing through holes 11 in bushing support 10 into threaded openings (receiving areas) 21 formed in hanger 20. Locknuts 31 help secure the machine screws and the hanger to the bushing support.

As seen in FIGS. 2 and 4, axles 50 are dimensioned for securement within longitudinal cylindrical openings 23 formed at each end of the hanger. Each axle is secured within these openings by a grub screw 40 as best seen in FIG. 2. Wheels 26 are secured to the axles as best seen in FIGS. 1 and 1A-1D.

Machine screws 30, grub screws 40, and axles 50 may have a hexagonal indented end 29 as best seen with regard to axle 50, which allows these fasteners to be easily tightened by means of a hex-type wrench. As seen in FIG. 2, axles 50 are positioned in openings 23 at each end of hanger 20.

As is readily apparent in FIGS. 1-3, the hanger 20 provides for easy disassembly with respect to the skateboard truck by simply removing machine screws 30, thereby allowing the hanger to be removed from the bushing support. In this way, if a hanger becomes damaged through use of the skateboard, such as in acrobatic use where the hanger rubs against edges of pipes and the like, then the hanger can be replaced with a new hanger without requiring the entire skateboard truck to be replaced. Furthermore, different hangers can have different lengths, thereby allowing the overall skateboard to be used for different applications, such as short length hangers for acrobatic use and longer length hangers for more traditional non-acrobatic uses.

The hanger 20 can be fabricated with different techniques, including forming the hanger from aluminum stock which has been formed using billet fabricating technology. Such hangers are found to be more durable and less brittle than hangers formed by forging technology.

Figure 8:
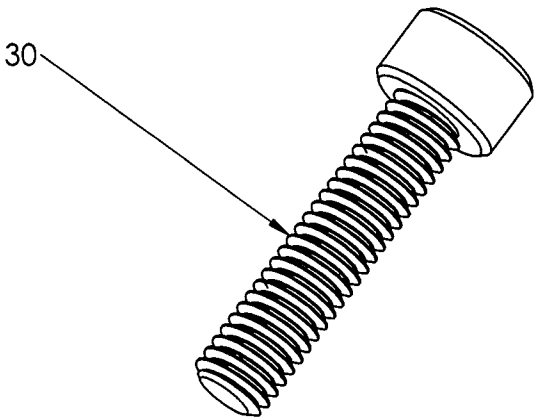
FIG. 8 is a perspective view of a machine screw used to attach the hanger to the bushing support.
Figure 9:
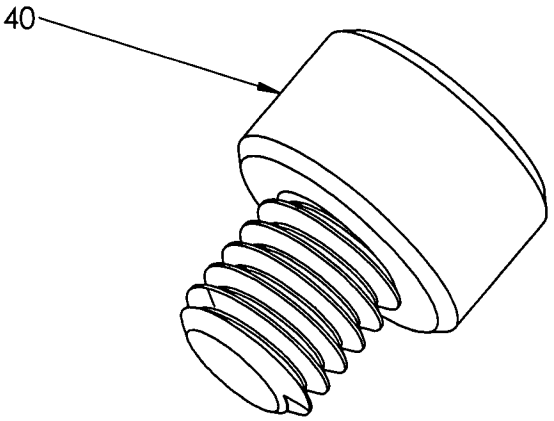
FIG. 9 is a perspective view of a grub screw used to secure the axle to the hanger.
Figure 10:
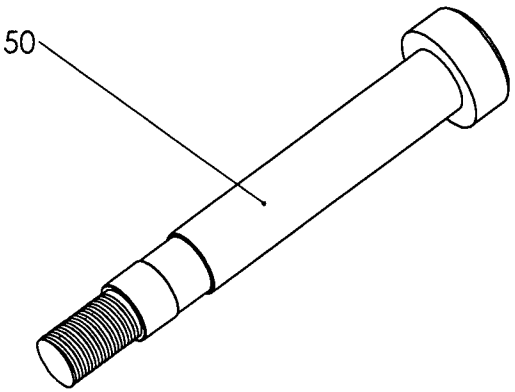
FIG. 10 is a perspective view of the axle.

Details of machine screws 30, grub screws 40 and axles 50 are shown in FIGS. 8, 9, and 10 respectively.

The overall result of the present invention provides for an easily removable hanger from a skateboard truck thereby allowing hangers to be easily replaced or exchanged depending upon the needs and use of the skateboard.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

Having described the invention, what is claimed is:

1. A skateboard truck comprising:

a base plate;

a bushing support having passthrough holes formed therein; and a fastener assembly configured to secure the bushing support to the base plate, the fastener assembly comprising a kingpin extending from the base plate and through an additional opening in the bushing support;

fasteners configured to pass through the passthrough holes, a hanger having threaded openings formed therein, the threaded openings configured to receive the fasteners passing through the passthrough holes of the bushing support so as to removably secure the hanger to the bushing support, the hanger further having openings formed at first and second ends, and axles configured to engage said openings in the hanger at said first and second ends of the hanger.

2. The skateboard truck according to claim 1, further comprising bushings positioned around the kingpin and on both sides of said additional opening in the bushing support.

3. The skateboard truck according to claim 2, wherein the bushings are fabricated from an elastically resilient material.

4. The skateboard truck according to claim 1, wherein the bushing support further includes a protrusion dimensioned for receipt within an aperture formed within the baseplate.

5. The skateboard truck according to claim 4, wherein the protrusion terminates with a hemispherically shaped end.

6. The skateboard truck according to claim 1, wherein each axle is secured to the hanger by a grub screw.

7. The skateboard truck according to claim 1, wherein the hanger is fabricated from billet aluminum.

8. The skateboard truck according to claim 1, wherein the fasteners are machine screws and wherein the skateboard truck further comprises a locknut positioned around each machine screw.

* * * * *